US007617076B2

(12) United States Patent
Rousu et al.

(10) Patent No.: US 7,617,076 B2
(45) Date of Patent: Nov. 10, 2009

(54) METHOD AND SYSTEM FOR FORMING A STRUCTURE

(75) Inventors: Ville Rousu, Helsinki (FI); Pertti Alho, Helsinki (FI); Jukka Partanen, Espoo (FI); Jukka Suomi, Espoo (FI); Ragnar Wessman, Espoo (FI)

(73) Assignee: Tekla Corporation, Espoo (FI)

( * ) Notice: Subject to any disclaimer, the term of this patent is extended or adjusted under 35 U.S.C. 154(b) by 834 days.

(21) Appl. No.: 10/641,033

(22) Filed: Aug. 15, 2003

(65) Prior Publication Data

US 2004/0031231 A1 Feb. 19, 2004

Related U.S. Application Data

(63) Continuation of application No. 10/455,407, filed on Jun. 6, 2003, now abandoned.

(30) Foreign Application Priority Data

Jun. 7, 2002 (FI) ..... 20021097

(51) Int. Cl.
*G06F 17/50* (2006.01)

(52) U.S. Cl. ..... 703/1; 700/98; 345/418

(58) Field of Classification Search ..... 52/745.01, 52/745.05, 745.13, 745.19; 345/418–421, 345/433–435, 440; 364/468.03, 468.04, 364/468.25, 578; 395/118–120, 133, 140; 703/1, 2, 7, 8; 700/98, 118
See application file for complete search history.

(56) References Cited

U.S. PATENT DOCUMENTS

| | | | | |
|---|---|---|---|---|
| 5,859,786 | A | 1/1999 | Klein | |
| 6,272,447 | B1 * | 8/2001 | Gavin et al. | 703/1 |
| 6,996,504 | B2 * | 2/2006 | Novotny et al. | 703/1 |
| 7,016,749 | B2 * | 3/2006 | Kuzumaki et al. | 700/97 |
| 7,027,048 | B2 * | 4/2006 | Brombolich | 345/420 |
| 7,089,166 | B2 * | 8/2006 | Malthe-Sorenssen et al. | 703/10 |
| 2002/0107674 | A1 * | 8/2002 | Bascle et al. | 703/1 |
| 2002/0126131 | A1 * | 9/2002 | Davis | 345/582 |
| 2004/0015823 | A1 * | 1/2004 | Nolan | 717/104 |
| 2004/0267401 | A1 * | 12/2004 | Harrison | 700/182 |
| 2005/0091010 | A1 * | 4/2005 | Fox et al. | 703/1 |

FOREIGN PATENT DOCUMENTS

GB 2 365 567 A 2/2002

* cited by examiner

*Primary Examiner*—Richard E Chilcot, Jr.
*Assistant Examiner*—William V Gilbert
(74) *Attorney, Agent, or Firm*—Young & Thompson

(57) ABSTRACT

This invention relates to a method and systems to form structures from predefined elementary parts. In the invention at least two predefined elementary parts are combined for forming a desired structure. The part comprises desired features for the desired structure. A control means handles the combining of the elementary parts.

25 Claims, 6 Drawing Sheets

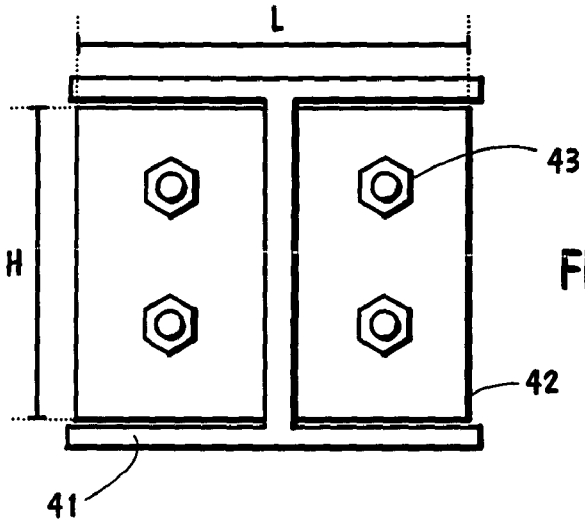
FIG. 4
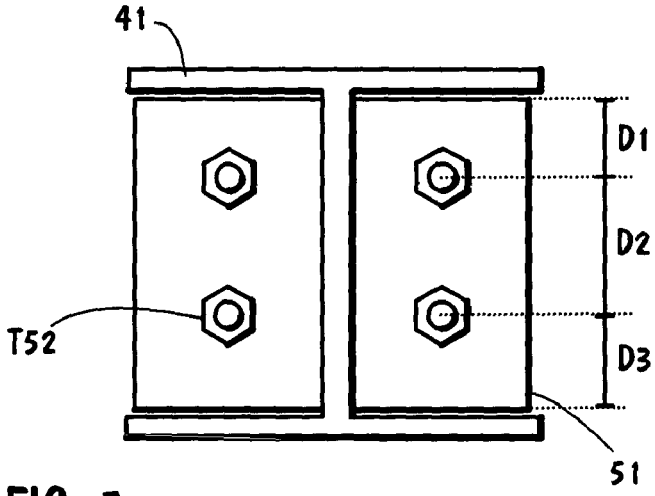
FIG. 5
FIG. 6
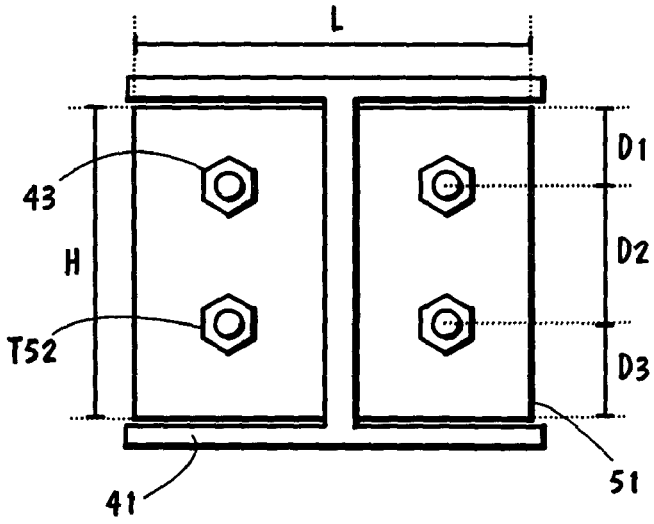

METHOD AND SYSTEM FOR FORMING A STRUCTURE

CROSS-REFERENCE TO RELATED APPLICATION

This application is a Continuation of U.S. patent application Ser. No. 10/455,407 filed Jun. 6, 2003. The entire content of the above-identified application is hereby incorporated by reference.

FIELD OF THE INVENTION

The invention relates to a method and system for forming structures. Especially, the invention relates to connections between construction elements. Furthermore, the invention relates to the method and system that can be used in a computer or in a corresponding device.

BACKGROUND OF THE INVENTION

When, for example, a building is constructed, the framework of the building must be made. FIG. 1 shows an example of a connection between two steel beams 2, 1. The connection comprises an endplate 4, which is fixed (normally welded) to the smaller beam 1, and bolted joints 3 that finally fix the smaller beam to the flange 5 of the bigger beam 2.

FIG. 2 shows an example of a connection among three beams 21, 22, 23. The first site beam 21 is connected to the flange 23A of the main beam 23 using an endplate 24 and bolted joints 25. The second side beam 22 is connected to the other side of the main beam using the same bolted joints 25, but now the endplate of the second beam is different due to the different size of the beam. This type of connection is called a two-sided connection. As can be noticed, there may exist a huge number of different connections between at least two construction elements. Naturally, a connection may be between a column and a beam, or between two columns etc.

At present, dedicated software (and/or hardware) is used for forming connections between construction elements. It is possible to define connection parameters, such as number of bolts, bolt locations, and plate dimensions. A single connection may comprise several dozens of attributes, which affect connection parameters and a final connection. The known solutions use fixed connections from among a desired connection (or connections) is searched. Further, the dedicated software or the hardware often has an option to save connections already made for future use. The saved connections can be used in the same kind of new situations (same elements, conditions, etc.) This feature can be called as an auto-default function.

The auto-default function utilizes a logic structure for using different connections already made. The logic structure makes it possible to search connections and to form new connections, whose locations in turn are determined in the logic structure. Furthermore, the auto-default function may automatically search a new connection in a modification situation. For example, the auto-default function searches a new connection when one of the beams to be connected changes.

FIG. 3 shows an example of the auto-default function in a flow chart. Let a task be to form a construction of an endplate of the connection. If the desired endplate already exists, it can be used, and the desired endplate is preferably searched from the group of existing endplates. The search is often divided into several levels. On level 1, elementary cases of the endplate are defined, on level 2 more special cases, and level 3 yet more special cases. It should be noticed that a number of the levels can be any suitable number depending on the complexity of endplate structures. On level 1 in FIG. 3, the logic structure of the auto-default function determinates 31 whether the desired endplate belongs to level 1 or level 2. The determination depends on, for example, the features of the steel beam, for which the endplate is formed. If the type of the desired endplate is a kind of modification that it does not comprise more specified features already determined, the auto-default function uses a basic endplate structure MOD1, which already exists. If the desired endplate comprises specified features, which already exist on level 2, the search continues on level 2.

On level 2, the logic structure has been constructed so that the suitability of a certain endplate modification is checked first. If this modification does not match with the desired endplate, the next endplate modification is checked and so on until a suitable endplate is found, the search continues on the next level, or the basic modification is selected. In FIG. 3, the endplate modification MOD21 is checked 32 first. If MOD21 is suitable, it is selected to be the endplate. Otherwise, the endplate modification MOD22 is checked 33. If MOD22 is suitable, it is selected to be the endplate. Otherwise, the endplate modification MOD23 is checked 34. If MOD23 is suitable, it is selected to be the endplate. Otherwise, the endplate modification MOD24 is checked 35. If MOD24 is suitable, it is selected to be the endplate. Otherwise, it is checked 36 does the desired endplate belongs to level 3. If the endplate belongs to the level 3, which comprises yet more specified features of the endplate, the search continues on level 3. Otherwise the basic endplate structure MOD1 is selected to be the desired endplate. It should be noticed that instead of using MOD1 as a basic default structure, level 2 could have (as all levels may have) its own basic default endplate structure 39.

On level 3, the search proceeds similarly as on level 2. The endplate modification MOD31 is checked 37 first. If MOD31 is suitable, it is selected to be the endplate. Otherwise, the endplate modification MOD32 is checked 38. If MOD32 is suitable, it is selected to be the endplate. Otherwise the basic endplate structure MOD1 is selected to the desired endplate. Alternatively, a level 3 specific default endplate may be selected.

So, if the MOD31 is the desired endplate, the search goes through the logic structure elements 31, 32, 33, 34, 35, 36, and 37. However, a problem occurs when MOD31 is the closest endplate desired to construct, but not exactly the one. Thus, MOD31 must be modified to form a new endplate (for example fewer bolts) by a user. The new endplate may be saved into the group of already saved endplates. As can be noticed, a number of saved endplates (or other connection elements) may increase very huge and the saved cases may be in any part of the logic structure. It is clear that this kind of system is tedious to set up and update, and difficult to maintain.

Especially the logic structure used, comprising several levels and logic structure components, makes the set up and the maintenance tedious. It is also known to use a matrix as a logic structure, but it is even more tedious and difficult than the tree structure of FIG. 3.

In real applications, the parameters of elements (structures) come from different sources. An engineer may give, for example, a number of bolts or plate dimensions. General design definitions may define, for example, a weld size based on the forces of on an element. Manufactures have their own preferences, such as type of bolts. Thus, the auto-default function works properly, when the fixed elements comprise exactly the same constructions. But when a project comprises elements from different manufactures, structures are different, connections are different, and so on. Thus the existing auto-default set up is relatively useless, so it must be set up again for the new project as well.

So, the known solutions contain a great number of predefined solutions, making them relatively fixed and rigid to use. The maintenance and updating of the known systems are very tedious or even impossible because of the complexity of the systems. For example, if the setup of the system has been made for the practice of a certain country, it may or may not be used according to the practice of another country. Or only a part of the existing system is usable, and even then the complexity of the system may prevent the use.

Due to these mentioned matters, it is clear that the present solutions need improvements. The goal of this invention to alleviate the above mentioned drawbacks of known solutions. The goal is achieved in a way described in the claims.

SUMMARY OF THE INVENTION

The invention is based on the idea that at least two predefined elements, i.e. elementary parts, are combined together for forming a desired structure. When thinking about a connection example, at least two predefined connections, i.e. connection elements or elementary parts, are combined together for forming a desired connection. The first predefined connection preferably comprises elementary features for the desired connection. The second predefined connection has certain desired features for the desired connection. The next optional predefined connections comprise other and/or more detailed features. A control means handles the combining of the predefined connections, preferably in such a way that the parameters of a previous connection, i.e. the connections that comprises features on a broader level, are overridden by the same parameters of the next connection. If the next connection defines parameters that are not defined in the previous connections they are added to a new connection as well as the overridden parameters.

Further, the invention concerns a forming of elementary parts. They are formed by selecting common parameters from a group of structures forming the predefined elementary parts.

In the inventive way, it is possible to keep a number of predefined structures and logic structure components relatively limited compared to possible formable structures.

So, an inventive system comprises at least means for searching elementary parts for the structure to be formed, means for forming said structure by combining the elementary parts, and a control means for controlling the second means.

The inventive method comprises at least the steps of: searching a first elementary part having elementary features for the structure, searching next elementary part having certain features for the structure, and combining the first elementary part and the next elementary part according to a control means.

BRIEF DESCRIPTION OF THE DRAWINGS

In the following the invention is described in more detail by means of FIGS. 1-9 in the attached drawings where, FIG. 4 illustrates an example of elementary parameters of an endplate, FIG. 5 illustrates an example of certain more detailed parameters of an endplate having the same basic structure as the endplate in FIG. 4, FIG. 6 illustrates an example of a combination of the parameters from the endplates in FIGS. 4 and 5.

DETAILED DESCRIPTION OF THE INVENTION

As mentioned, at least two predefined elementary parts are combined together for forming a desired structure. The elementary parts may be other structures or groups of parameters. Let's think that the desired structure is a connection. The first elementary part (for example another connection) preferably comprises elementary features for the desired connection, and the next elementary parts comprise more detailed features. Let's examine FIG. 4, which illustrates an example of elementary parameters of an endplate. The steal beam profile 41 is considered to be known. The parameters showed in FIG. 4 are thought to be elementary parameters for the endplate, i.e. the length L and height H of the plate, a number of bolted joints 43, and the thickness 42 of the plate.

FIG. 5 illustrates an example of more detailed parameters of an endplate having the same basic structure as the endplate in FIG. 4, Both endplates are essentially for the same steel beam profile, in this example for exactly the same. The detailed parameters may, for example, be exact position parameters D1, D2, and D3 of the bolted joints on the endplate, the type T52 of the bolted joints, and the new thickness 51 of the endplate.

If the parameters of the endplates of FIGS. 4 and 5 are combined, it is possible to form a new endplate. FIG. 6 illustrates an example of a combination from the endplates in FIGS. 4 and 5. As can be noticed, the parameters of the second endplate (FIG. 5) are added to the parameters of the first endplate (FIG. 6). It can also be noticed that if a certain parameter already exists in the first endplate, it is overridden by the same parameter in the second (or the next) endplate. As the situation is concerning the thickness of the endplate, when the new thickness 51 substitutes the old thickness 42. It should be mentioned that a control means, which determinates that old parameters are overridden, may control the combining function to overwrite a new value and use the old value. In other words, several different ways to combine predefined connections may exist.

Further, the parameters in the elementary parts may be defined as a function and/or functions instead of parameters. For example, the number of bolted joints 43, is a function of the profile of a steal beam that is a distinct structure (not an endplate). The function of the endplate is calculated either before combining it with another endplate, or the function is calculated in the combination step. Taking into account these matters, the combination step may also utilize mathematical operations (such as different formulas).

Figure 7:
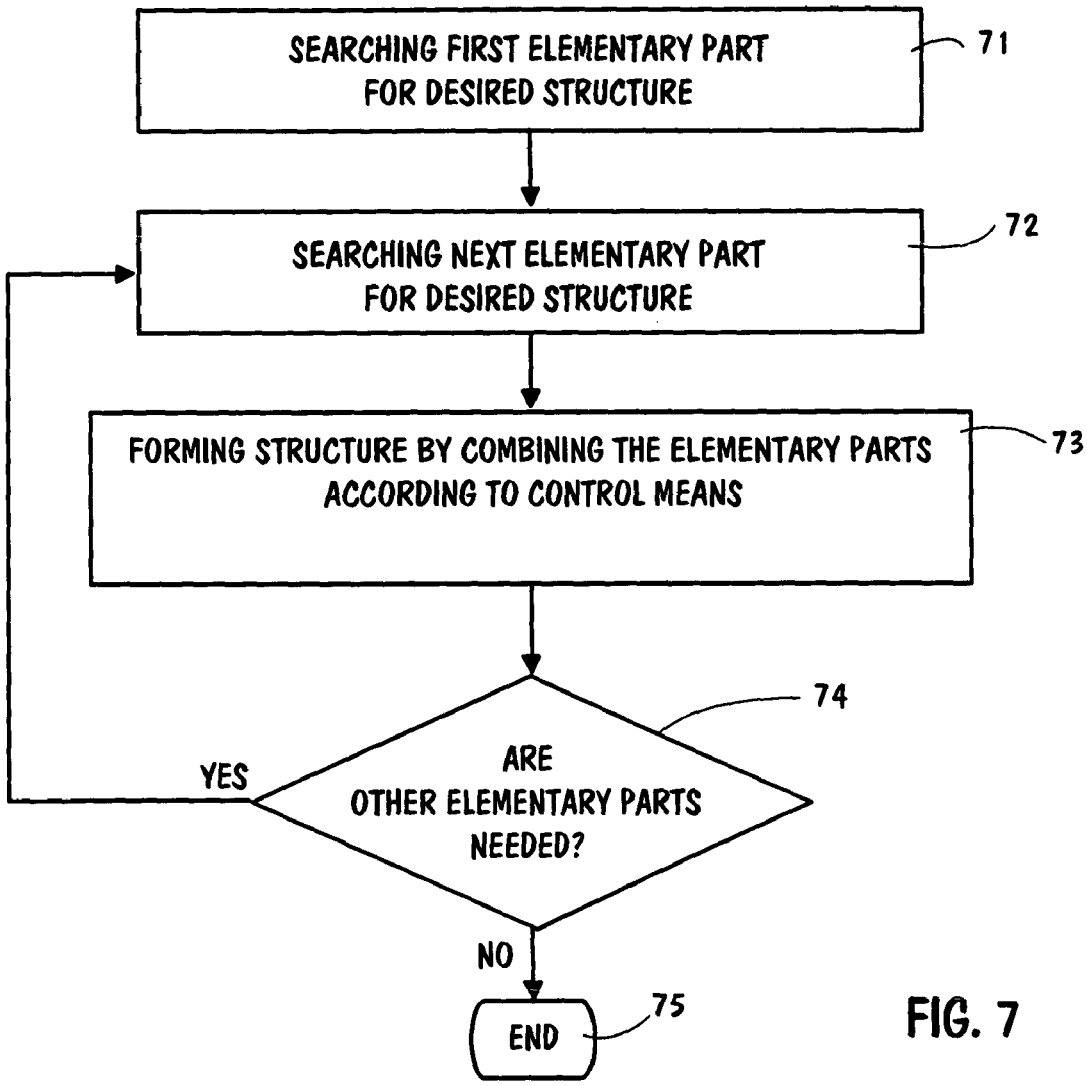
FIG. 7 illustrates an example of a flow chart describing the inventive method.

FIG. 7 illustrates an example of a flow chart describing the inventive method. At the beginning, a first elementary part is searched 71 through the logic structure of a inventive system. The first elementary part preferably comprises elementary features for a structure that is to be formed. After this, the next elementary part is searched 72. It comprises more desired features for the desired structure. The elementary parts are combined 73 according the control means for forming a new structure. The new structure is considered to be the desired structure when the performance of the method ends 75. However, if other elementary parts are needed 74 for forming the desired structure, the steps of searching the next elementary part 72 and forming a new structure 73 are repeated. These steps are repeated until the desired structure is formed. A result structure may be as close as possible to a real structure which is desired to form. In this case, the result structure is modified to form the real desired structure.

Figure 8:
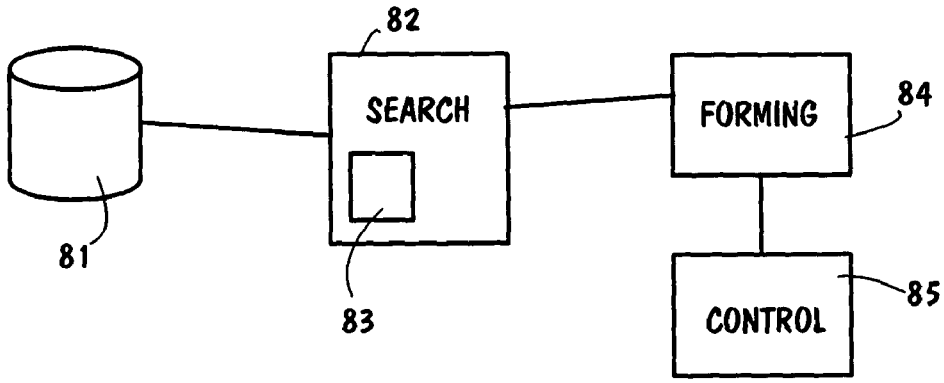
FIG. 8 illustrates an example of a system according to the invention.

FIG. 8 illustrates an example of a system according to the invention comprising preferable elements. A search means 82 searches suitable structures from a data repository, such as a database 81, or from files. As mentioned before, the search means may comprise a logic structure, which in turn comprises logic structure elements, for handling the searches. The logic structure elements that are functionally connected to each other forms a tree structure. The tree structure is preferably divided into several levels, wherein each levels handles certain types of the elementary parts. Due to this, each level also handles searches for elementary parts having level specific features. It should be mentioned that the higher levels of the tree preferably comprise elementary structures for a desired structure in question. The search means comprises a repeater means 83 for repeating searches and combinations. The searches and combinations are repeated until a necessary number of predefined features (structures or piece of information) have been sought and combined for forming a desired structure. The system also comprises a forming means 84 for forming the desired structure from at least two predefined elementary parts. The forming means are controlled by a control means 85, which controls the way, which is used for combining the elementary parts.

Figure 9:
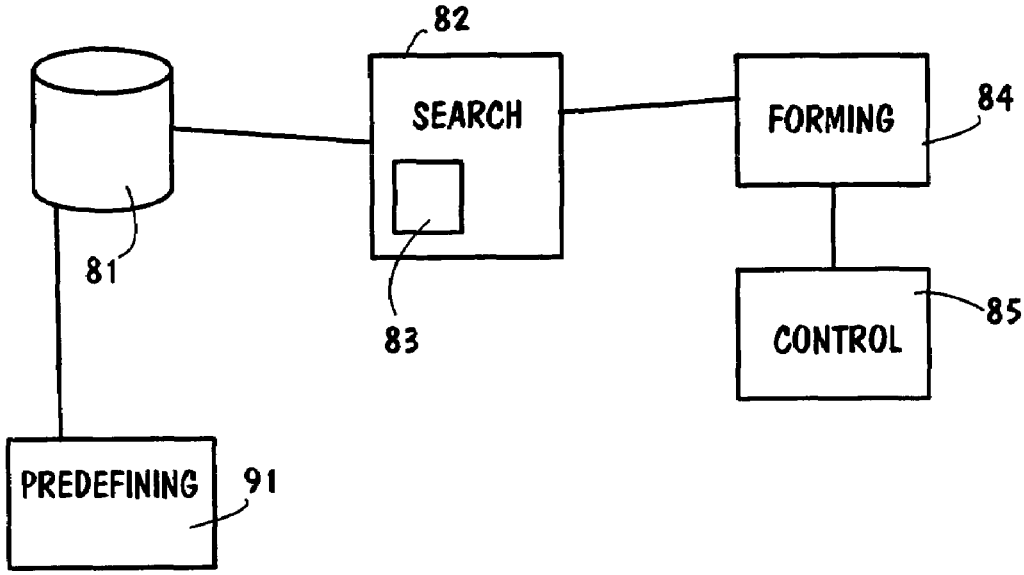
FIG. 9 illustrates another example of a system according to the invention.

FIG. 9 illustrates another example of a system according to the invention comprising means 91 for forming the predefined elementary parts. The forming means selects common parameters from of a group of structures for forming said predefined elementary parts. The group of structures may be, for example, structures that a user has created in his terminal. Using some kind of selecting module, such as a filter, common parameters and other features may be found in the group of the structures. The selected parameters (and features) are used for forming the elementary parts, which are saved.

Figure 1:
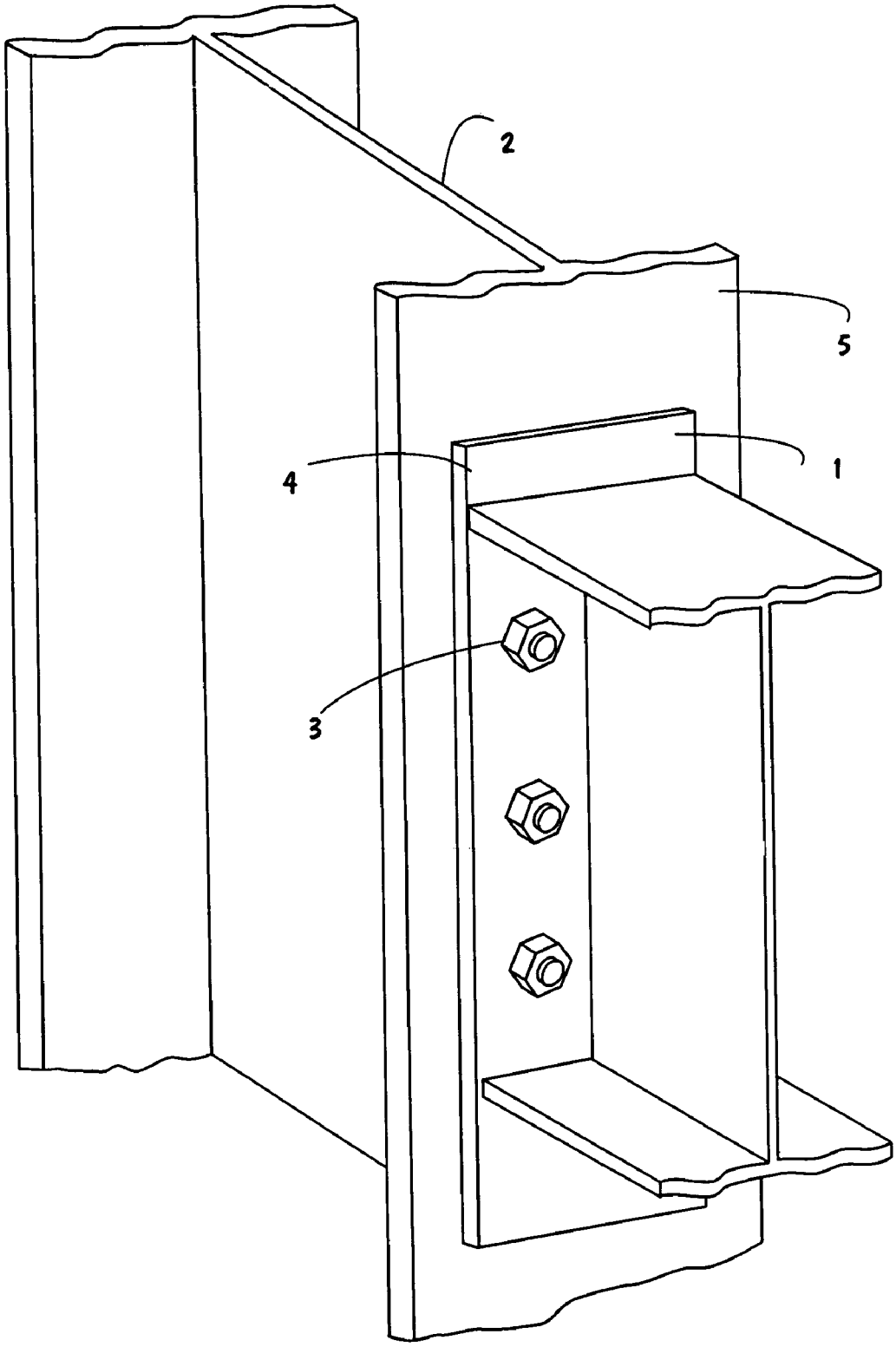
FIG. 1 illustrates an example of a connection between two steel beams.
Figure 2:
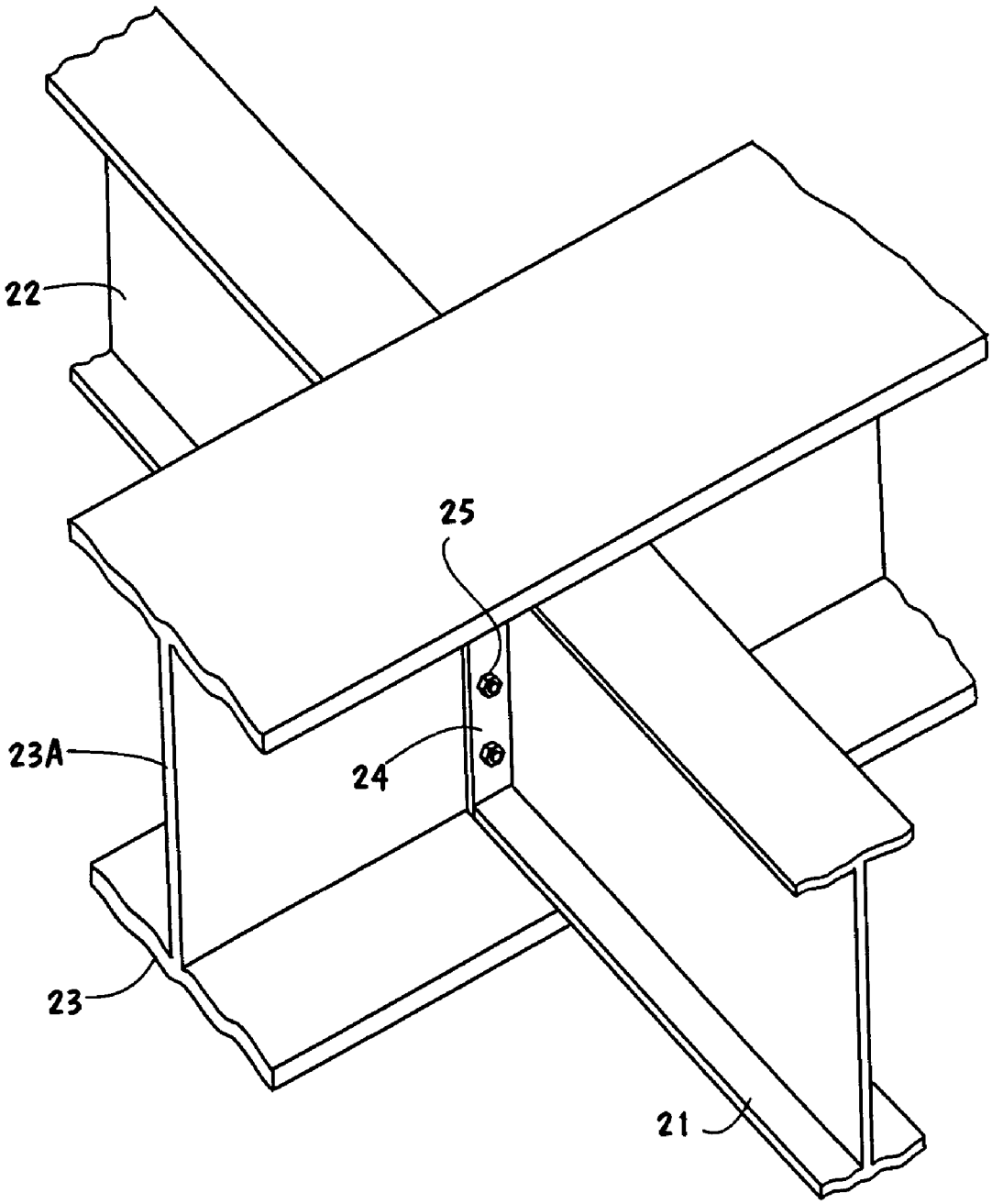
FIG. 2 illustrates an example of a connection between three steel beams.
Figure 3:
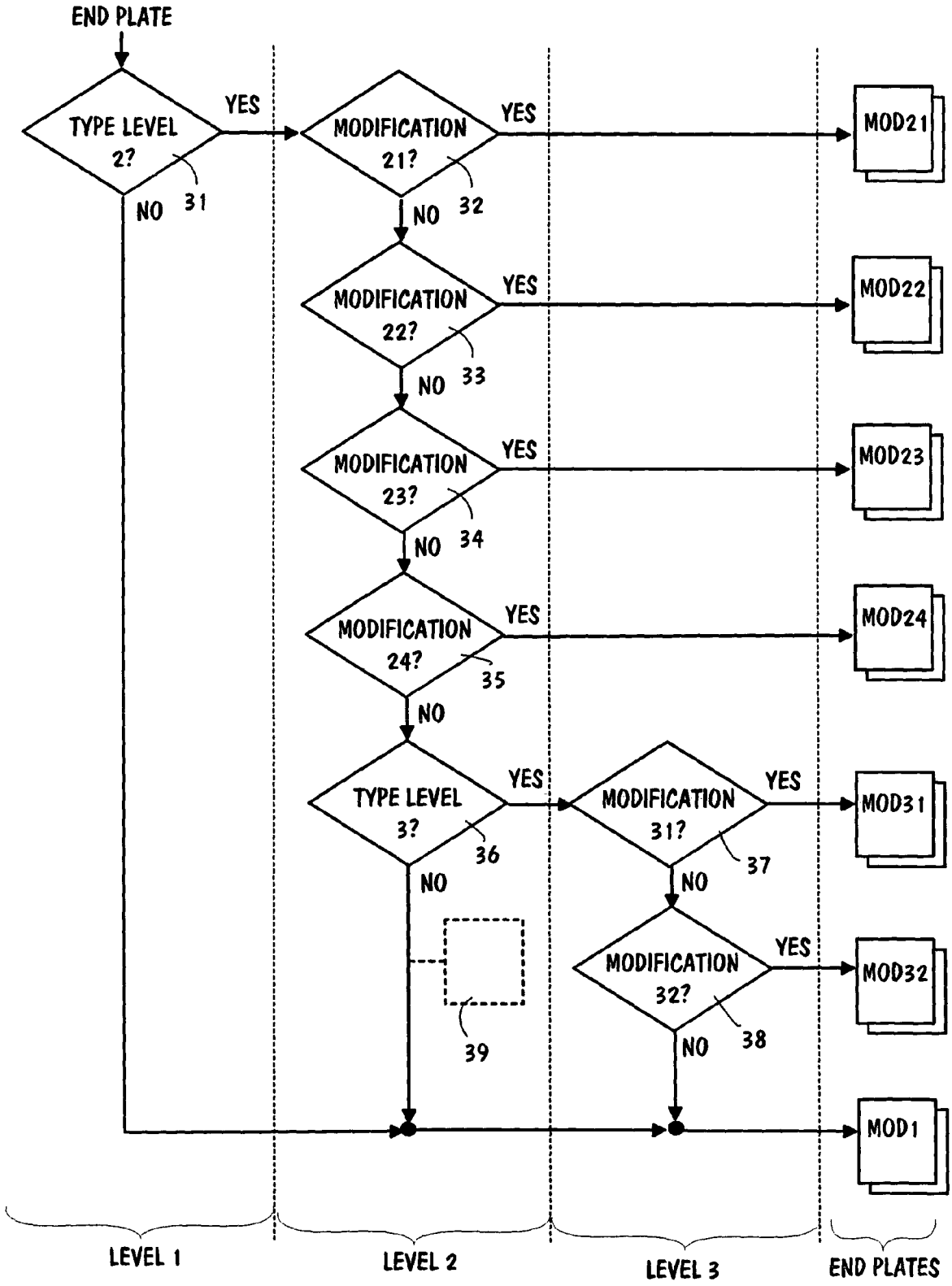
FIG. 3 illustrates an example of a known logic structure and it's components.

For clarifying the benefits of the invention, let's examine an example of wherein there exist 64 different endplate connections. Let's assume that there are four choices for a number of bolted joints: 2, 3, 4, or 5; four choices for the thickness of a plate: 10, 12, 14, or 16 millimeters; and four alternatives for cutting a beam: 1) up, 2) down, 3) on both edges, or 4) no cuttings. Due to this 64 (4*4*4=64) alternatives exist. Now, a logic structure (compare FIG. 3) is used to find a desired connection: Let a beam height be under 180 millimeters, loading force under 100 kN, and the location of the beam central (meaning no cuttings). On the first level, the logic structure restricts suitable beams to be under 180 millimeters. On the second level, the logic structure restricts suitable beams into a group of beams that are loaded under 100 kN. Finally, on the last level (in this example), the logic structure finds the connection wherein the beam has not been cut. Let the searched connection be a plate with 2 bolted joints, 10 mm thick, and no cuttings.

Considering this same example in a preferable system according to the invention, only 12 predefined connections are needed: four connections for a different number of bolted joints, four connections for a different number of thickness, and four connections for different cuttings. Now, the logic structure selects the connection of two bolted joints on the first level (the height of the beam under 180 mm). On the second level (force under 100 kN), the connection with a 10 mm thick plate is selected, and on the last level, the connection with no cuttings is selected. These three, selected connections are combined for forming the desired connection. As can be noticed, only 12 (4+4+4=12) predefined connections are needed to form 64 different connections. It should be mentioned that in real cases numbers of parameters are much greater than in this example.

The invention decreases a number of predefined structures, which have to be stored in somewhere, for example, in a database or files. The logic structure is also simpler than in previous solutions, making it easier to set up and maintain. The levels of the logic structure may be adjustable for users or not. If a level (or levels) is not adjustable, it means that users cannot make any changes of theirs own and thus cannot make any errors. This is preferable, in particular when the level defines, for example, manufactures set ups, which should be fixed and not changeable. A preferable system for the invention is a level structure wherein each level comprises logic structure components, forming a tree structure (See FIG. 3). Due to the above-mentioned matters the inventive system is easy to set-up and maintain—even to end-users. The creation of structures is preferably automatic. Also the forming of the elementary parts may be automatic, when a user does not have to take care of this matter.

Although, above it is mostly described the endplate connections between steel beams, the connections can be any connections or structures between any elements such as columns and beams. The elements may be pipes, and the connections may be pipe connections. The elements may be pipes and concrete elements, and the connections may be pipe hangers. The elements may be concrete elements and the connections concrete reinforcements. The elements may be timber joist, and the connections may be timber joints. In fact, the elements and connections may be any modeled elements and connections. The modeled elements and connections mean that they have been modeled in some way, such as by suitable software. The modeled, predefined elementary parts and structures (elements, connections, connections elements etc.) are preferable to use when forming connections between elements. The desired structure does not need to be a connection between two elements (Although this is a preferable application.), but it can actually be a new structure, which is formed from at least two predefined elementary parts. The modeled structures and elementary parts may be objects. The objects are software components, which can be modified and which are reusable. The inventive method and system can be realized using software and/or hardware modules, when they form marketable products for end-users.

The invention is not restricted to above-mentioned examples. However, it is clear that other solutions than described in this text can be used in the scope of the inventive idea.

The invention claimed is:

1. A method for forming a model of a physical structure in a computer-aided modeling method, the method comprising:

storing in a data repository a number of models of basic physical structures, each model containing a parameter set defining characteristics of a corresponding basic physical structure;

receiving an indication of at least one other structure for which the model of the physical structure is to be formed;

determining characteristics of the at least one other structure;

searching, on the basis of the determined characteristics, for a first model;

finding the first model having a parameter set defining at least one characteristic that satisfies at least one of the determined characteristics;

searching, on the basis of the determined characteristics, for a second model;

finding the second model having a parameter set defining at least one characteristic that satisfies another determined characteristic; and forming the model of the physical structure by combining parameters in the parameter set of the first model and parameters in the parameter set of the second model according to a predefined stored definition how to combine elementary and detailed parameters in the parameter sets to form the model of the physical structure.

2. The method according to claim 1, wherein the method further comprises the steps of:

searching for a next model;

finding the next model having a parameter set defining at least one characteristic that satisfies a further determined characteristic; and forming a new version of the model of the physical structure by combining parameters of the model of the physical structure formed earlier and parameters in the parameter set of the next model according to the predefined definition;

said searching, finding and forming being repeated until a model of a desired structure is formed.

3. The method according to claim 2, wherein the predefined definition defines to use, in response to the elementary parameter, a parameter value of the elementary parameter in the next parameter set.

4. The method according to claim 2, wherein the predefined definition defines to add, in response to a detailed parameter in the parameter set of the next model, the detailed parameter to the parameters of the model of the physical structure formed earlier.

5. The method according to claim 2, wherein the searching is performed in a logic structure comprising levels and wherein each level comprises at least one logic structure so that the logic structures form a tree structure.

6. The method according to claim 5, wherein each level of the logic structure handles searching of certain level specific parameters of parameter sets.

7. The method according to claim 1, wherein the predefined definition defines to use, in response to the elementary parameter, a parameter value of the elementary parameter in the parameter set of the second model.

8. The method according to claim 1, wherein the predefined definition defines to add, in response to a detailed parameter in the parameter set of the second model, the detailed parameter to the parameters in the parameter set of the first model.

9. The method according to claim 1, wherein the at least one other structure comprises at least two construction elements and the physical structure to be formed is a connection between at least two construction elements.

10. The method according to claim 1, wherein the method further comprises predefining logic structures for the models.

11. The method according to claim 10, wherein the logic structures include parameters of parameter sets.

12. The method according to claim 1, wherein the models are objects stored in a data repository.

13. The method according to claim 1, wherein the basic physical structures are selected from the group consisting of pipes and connections for pipes.

14. The method according to claim 1, wherein the basic physical structures are selected from the group consisting of concrete structures and concrete reinforcements.

15. A computer aided modeling system for forming a model of a physical structure the system comprising:

a memory containing a number of models of basic physical structures, each model containing a parameter set defining characteristics of a corresponding basic physical structure;

a search means for searching from the memory for models having parameter sets defining at least one characteristic that satisfies at least one of characteristics of at least one other structure for which the model of physical structure is to be formed;

a combine means for forming said model of the physical structure by combining models found by the search means;

a control means for controlling the combine means, said control means being configured to combine the models found by the search means according to a predefined stored definition of how to combine elementary and detailed parameters in the parameter sets to form the model of the physical structure; and a user interface for showing the formed model of the physical structure to a user of the system.

16. The system according to claim 15, wherein the predefined definition defines to use, in response to an elementary parameter, a parameter value of the elementary parameter in a parameter set of a last found model.

17. The system according to claim 15, wherein the predefined definition defines to add, in response to the detailed parameter in a parameter set of a later found model, the detailed parameter to the parameters in the parameter set of a first found model.

18. The system according to claim 15, wherein the at least one other structure comprises at least two construction elements and the physical structure to be formed is a connection between the at least two construction elements.

19. The system according to claim 15, wherein the system further comprises a predefinition means for predefining logic structures for the models.

20. The system according to claim 19, wherein in the logic structures include parameters of parameter sets.

21. The system according to claim 15, wherein the search means performs the search in a logic structure comprising levels, each level comprising at least one logic structure so that the logic structures form a tree structure.

22. The system according to claim 21, wherein each level of the logic structure handles searching of certain level specific parameters of the models.

23. The system according to claim 15, wherein the indicated structure is selected from the group consisting of beams and columns used in constructions.

24. A computer program product embodied in a computer-readable storage medium and comprising program instructions, wherein execution of said program instructions causes a computer containing the computer program product to:

determine, in response to an indication of at least one structure for which a model of a further physical structure is to be formed, characteristics of the at least one structure;

search, on the basis of the determined characteristic, from a memory containing a number of models of basic physical structures, each model containing a parameter of set defining characteristic of a corresponding basic physical structure, for a first model having a parameter set defining at least one characteristic that satisfies at least one of the determined characteristics;

search, on the basis of the determined characteristics, from the memory for a second model having a parameter set defining at least one characteristic that satisfies another determined characteristic; and, in response to finding the first and second model, form a model of the further physical structure by combining parameters in the parameter set of the first model and parameters in the parameter set of the second model according to a predefined stored definition how to combine, elementary and detailed parameters in the parameter sets to form the model of the physical structure.

25. A method for forming a model of a physical structure in a computer-aided modeling method, the method comprising:

storing in a data repository a number of models of elements, each model having a parameter set defining characteristics of a corresponding element;

determining characteristics required for the physical structure;

searching, on the basis of the determined characteristics, for a first model;

finding the first model having a parameter set defining at least one characteristic that satisfies at least one of the determined characteristics;

searching, on the basis of the determined characteristics, for a second model;

finding the second model having a parameter set defining at least one characteristic that satisfies another determined characteristic; and forming the model of the physical structure by combining parameters in the parameter set of the first model and parameters in the parameter set of the second model according to a predefined stored definition of how to combine elementary and detailed parameters in the parameter sets to form the model of the physical structure.

* * * * *

UNITED STATES PATENT AND TRADEMARK OFFICE

CERTIFICATE OF CORRECTION

PATENT NO. : 7,617,076 B2
APPLICATION NO. : 10/641033
DATED : November 10, 2009
INVENTOR(S) : Rousu et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1294 days.

Signed and Sealed this

Nineteenth Day of October, 2010

David J. Kappos

David J. Kappos
*Director of the United States Patent and Trademark Office*